US005578383A

United States Patent [19]

Beyer et al.

[11] Patent Number: 5,578,383

[45] Date of Patent: Nov. 26, 1996

[54] PRECIOUS-METAL MATERIAL FOR ARTICLES OF JEWELRY AND A METHOD OF MANUFACTURING THEM

[75] Inventors: Hans-Hermann Beyer, Kahl; Karl-Anton Starz, Rodenbach, both of Germany

[73] Assignee: Degussa Aktiengesellschaft, Frankfurt, Germany

[21] Appl. No.: 421,157

[22] Filed: Apr. 10, 1995

[30] Foreign Application Priority Data

Apr. 13, 1994 [DE] Germany ..... 44 12 715.4

[51] Int. Cl.[6] ..... B22F 3/00

[52] U.S. Cl. ..... 428/551; 75/228; 75/252; 252/514; 106/1.21; 29/896.4; 419/66; 524/785; 524/780

[58] Field of Search ..... 428/546, 551; 75/228; 429/10, 32, 36, 38, 45, 61, 66; 29/160.6; 252/512, 514; 501/19; 106/1.21

[56] References Cited

U.S. PATENT DOCUMENTS

| | | | |
|---|---|---|---|
| 3,932,311 | 1/1976 | Caldwell et al. | 252/514 |
| 4,150,995 | 4/1979 | Moritsu et al. | 106/1.21 |
| 4,401,767 | 8/1983 | Dietz et al. | 501/19 |
| 4,476,090 | 10/1984 | Heidsiek et al. | 419/19 |
| 5,183,784 | 2/1993 | Nguyuen et al. | 501/19 |

*Primary Examiner*—Charles T. Jordan
*Assistant Examiner*—Anthony R. Chi
*Attorney, Agent, or Firm*—Beveridge, DeGrandi, Weilacher & Young, L.L.P.

[57] ABSTRACT

A precious-metal material for articles of jewelry and having low specific weight, high resistance to corrosion, in spite of a low content of precious metals, and free from toxic constituents which consists of 33 to 99 wt. % precious metal powder, 1 to 67 wt. % of a thermosetting organic plastics and 0 to 10% filler.

10 Claims, No Drawings

PRECIOUS-METAL MATERIAL FOR ARTICLES OF JEWELRY AND A METHOD OF MANUFACTURING THEM

INTRODUCTION AND BACKGROUND

The present invention relates to a precious-metal material for articles of jewelry comprising precious metal powders and a non-metallic additive. The invention also relates to a method of manufacturing these materials and jewelry articles.

Throughout history, jewelry has been manufactured from precious metals such as gold, silver, platinum, palladium and particularly from alloys thereof. There are a number of known precious-metal alloys used for such purposes, the main component normally being the precious metal. Gold alloys in particular are classified as 8, 9, 14, 18 or 20-carat, i.e. depending on their gold content. An alloying of base metals is needed for improving the mechanical properties of the jewelry alloys, such as hardness and resistance to wear.

Some of these alloys contain heavy-metal constituents such as nickel or lead which can cause allergies. There is therefor a need for jewelry materials which are free from heavy metals.

Today the selling price of jewelry made from precious metals is closely dependent on the cost of the precious metals therein. The object of the jewelry industry, therefor, is to use materials with a low content of precious metals. These efforts, however, are limited by the fact that low-carat alloys (8 or 9 carats) have unsatisfactory physical and chemical properties, particularly a tendency to oxidation and corrosion.

DE-PS 31 35 034 (U.S. Pat. No. 4,476,090 which is incorporated by reference in its entirety) discloses a jewelry material containing a glass component in addition to precious metal. This material, however, has the disadvantage that only about 5 or 6 wt. % of glass can be added without drastically impairing the manufacturing properties of the material. In addition, due to the glass component, the material contains oxides of heavy metals such as lead, zinc or tin which can cause allergies.

Another object of the jewelry industry is to use lighter precious-metal materials and hollow articles of jewelry, such as earrings or pendants, so that they are lighter and more comfortable to wear. Electroplated hollow jewelry has become increasingly important in this sector in recent years. Methods of manufacturing electroformed hollow gold jewelry are described e.g. in DE-PS 33 09 397 (U.S. Pat. No. 4,487,664 which is incorporated by reference in its entirety). The general disadvantage of hollow jewelry, however, is that it has low strength and is easily deformed under impact and pressure. It also sounds hollow and tinny when struck.

SUMMARY OF THE INVENTION

One object of the present invention is to provide a precious-metal material for articles of jewelry comprising precious metal powders and a non-metallic additive, the material having a low content of precious metals but being corrosion-resistant, having a low specific weight, containing no toxic components and being suitable for engraving. It should also be suitable for filling the cavities in hollow jewelry. Another object is to develop a method of producing these materials and articles of jewelry.

To this end, according to the present invention, the material comprises 33 to 99 wt. % precious-metal powders or alloy powders with a high content of precious metal, containing more than 60 wt. % precious metal, 1 to 67 wt. % of a crosslinkable polymer and 0 to 10 wt. % of a finely divided inorganic filler.

DETAILED DESCRIPTION OF THE INVENTION

Any crosslinkable polymer can be used as the thermosetting organic plastic. Preferably, however, use is made of casting resins which can be cured by suitable additives as is known in the art (see Handbook Of Plastics, 2nd Edition, H. R. Simonds, A. J. Weith and M. H. Bigslow, D. Van Nostrand Company, Inc., New York, especially pages 920–921, which are incorporated by reference in their entirety, and Principles Of High-Polymer Theory And Practice, 1st Edition, A. X. Schmidt and C. A. Marlies, McGraw-Hill Book Company, Inc., New York, 1948, especially pages 663–664 which are incorporated by reference in their entirety). The fillers can be the known materials used in plastics technology, particularly finely-dispersed silica, silicates or aluminum powder.

The main precious metals used are gold, silver or platinum, preferably in a powder size of 1 to 100 μm. In addition, a percentage of non-toxic base metals can be alloyed with the precious metals.

Advantageously the materials and articles of jewelry are manufactured by mixing the precious-metal powder and the crosslinkable polymer, placing them in a mold corresponding to the jewelry or in the cavity of a hollow jewelry article, and hardening them by action of known chemical reagents and/or energy.

During manufacture, the precious-metal material is liquid to pasty, of homogeneous composition and can be cast and shaped as required. After a certain time it hardens, resulting in solid articles of jewelry which are dimensionally stable and can be subsequently electroplated with precious metals.

The organic crosslinkable polymers are advantageously room temperature curing organic casting resins with a sufficiently long pot life. Two-component epoxy resin systems, two-component acrylate systems, polyurethanes, phenolic resins or silicone casting resins are examples.

In order to manufacture the materials, precious-metal powders and organic crosslinkable polymer corresponding to the desired precious-metal content (e.g., 18 carat=75% Au, 25% casting resin) are weighed together and homogenized. The mixture is then filled into, for example, a silicone mold or placed in an electroformed hollow article of jewelry. Subsequent hardening at room temperature occurs without shrinkage or blistering. It has unexpectedly been found that the mixture has a very high dimensional stability upon removal from the mold.

The materials according to the invention have a lower density than known jewelry alloys containing the same amount of precious metal. They are easy to work with and are corrosion-resistant.

The following examples will illustrate the invention in detail:

Example 1: The following components were weighed together and thoroughly homogenized in a container:

7.50 g gold powder (particle size≦30 μm);

0.83 g methyl methacrylate/styrene casting resin (component 1);

1.67 g methyl methacrylate/styrene casting resin (component 2), and 0.075 g accelerator powder (benzoyl peroxide).

The result was a pasty homogeneous mixture, filled for further processing into a dispensing cartridge. The processing time after adding the accelerator was 30 minutes. The substance was suitable for producing 18-carat gold jewelry.

Example 2: Two components were produced separately, i.e.:

Component A:

15.7 g gold powder (particle size≦45 μm);

4.3 g epoxy resin (bisphenol-A type, epoxy equivalent weight 180–250).

Component B:

14.3 g gold powder (particle size≦45 μm);

5.7 g epoxy accelerator (organic amine, liquid).

The two components were mixed, resulting in a gold-epoxy resin paste containing 75% gold (18-carat). The pasty material was poured into a dispensing device and subsequently processed. The pot life was equal to the processing time, i.e. about 30 minutes.

Example 3: The pasty gold and acrylic resin preparation manufactured in example 1 was filled into an electroformed article of hollow jewelry by a dispensing device. A slightly negative pressure was applied to prevent blisters during filling. The amount filled in was determined by measuring the weight of the jewelry before and after filling, so as to check that the article was completely filled. After filling, excess gold/acrylic resin was removed by a solvent, thereafter the material was hardened at room temperature in about 24 hours. After hardening, the jewelry can be engraved and optionally electroplated with gold. The jewelry had a solid, massive sound and was much less sensitive to impact and pressure than the corresponding article of hollow jewelry before filling.

Example 4: The pasty gold and acrylic resin preparation manufactured in example 1 was filled directly into the silicone mold for casting an article of jewelry. The silicone mold had previously been treated with a releasing agent (e.g., Teflon spray). The preparation had excellent dimensional stability after removal from the mold. After the material had been cast, it hardened at room temperature in about 24 hours. The silicone mold was then removed, the sprue channel was cut off and the jewelry was electroplated with gold. The thickness of the coating was between 3 and 10 μm. Thicker coatings are possible. The result was a solid article of jewelry which did not contain heavy metals and had a low weight. The gold content was 75% (18 carat).

Example 5: The following components were weighed together and thoroughly homogenized in a container:

8.5 g platinum powder (particle size≦30 μm);

0.5 g acrylate resin (component 1, analogous to example 1);

1.0 g acrylate resin (component 2, analogous to example 1), and 0.045 g accelerator powder (benzoyl peroxide).

The result was a pasty homogeneous mixture, which was filled for further processing into a dispensing cartridge.

The preparation was subsequently processed as described in examples 3 and 4, resulting in articles of jewelry with a platinum content of 850/1000.

Further variations and modifications of the foregoing will be apparent to those skilled in the art and such variations and modifications are attended to be encompassed by the claims that are appended hereto.

German Priority Application P 44 12 715.4, filed on Apr. 13, 1994, is relied on and incorporated by reference in its entirety.

What is claimed:

1. A precious-metal material for articles of jewelry, said precious-metal material comprising 33 to 99 wt. % precious-metal powder or alloy powder containing more than 60 wt % precious metal, 1 to 67 wt. % of a crosslinkable polymer and 0 to 10 wt % of a finely-divided inorganic filler.

2. The precious metal material according to claim 1, wherein said precious metal is selected from the group consisting of gold, silver, platinum and mixtures thereof.

3. The precious metal material according to claim 2, wherein said precious metal has particle sizes of 1–100 μm.

4. The precious metal material according to claim 1, wherein said finely-divided inorganic filler is selected from the group consisting of silica, silicate, and aluminum powder.

5. The precious metal material according to claim 1, wherein said crosslinkable polymer is a thermosetting casting resin.

6. The precious metal material according to claim 1, wherein said crosslinkable polymer is selected from the group consisting of two-component epoxy resin systems, two-component acrylate systems, polyurethanes, phenolic resins and silicone casting resins.

7. An article of jewelry made from the precious metal material according to claim 1.

8. The precious metal material according to claim 1, consisting essentially of 33 to 99 wt. % precious-metal powder or alloy powder containing more than 60 wt. % precious metal, 1 to 67 wt. % of a crosslinkable polymer and 0 to 10 wt. % of a finely-divided inorganic filler.

9. The precious metal material according to claim 8, wherein said finely-divided inorganic filler is selected from the group consisting of silica, silicate, and aluminum powder.

10. The precious metal material according to claim 1, consisting of 33 to 99 wt. % precious-metal powder or alloy powder containing more than 60 wt. % precious metal, 1 to 67 wt. % of a crosslinkable polymer and 0 to 10 wt. % of a finely-divided inorganic filler.

* * * * *